United States Patent [19]

Soeiinah

[11] 4,382,381

[45] May 10, 1983

[54] DETERMINING STRESSES AND LENGTH CHANGES IN WELL PRODUCTION TUBING

[75] Inventor: Edy Soeiinah, Carrollton, Tex.

[73] Assignee: Mobil Oil Corporation, New York, N.Y.

[21] Appl. No.: 297,452

[22] Filed: Aug. 28, 1981

[51] Int. Cl.[3] ..... E21B 47/024

[52] U.S. Cl. ..... 73/151; 33/303; 364/422

[58] Field of Search ..... 73/151; 175/45; 33/303, 33/304, 313; 364/422

[56] References Cited

PUBLICATIONS

"Helical Buckling of Tubing Sealed in Packers," A. Lubinski, W. S. Althouse and J. L. Logan, *Petroleum Transactions*, Jun. 1962, pp. 655–670.

"Movement, Forces, and Stresses Associated With Combination Tubing Strings Sealed in Packers," D. J. Hammerlindl, Feb. 1977, *J. of Pet. Tech.*, pp. 195–208.

"Tubing Movement, Forces, and Stresses in Dual Flow Assembly Installations," Kenneth S. Durham, SPE 9265, Paper presented at the 55th Annual Fall Technical Conference of the Society of Petroleum Engineers of AIME, Dallas, Texas, Sep. 21–24, 1980.

*Primary Examiner*—Howard A. Birmiel

*Attorney, Agent, or Firm*—C. A. Huggett; M. G. Gilman; G. W. Hager

[57] ABSTRACT

In the production or stimulation of a well, the length change of a string of tubing caused by temperature and pressure is determined for an inclined well. The weight of each section of the tubing is resolved into the axial component applied to the next successive section. For each of the successive sections the buckling force is determined from the actual force and the axial component of weight. This buckling force is compared to a threshold to determine if buckling occurs. The length change of the tubing between the initial condition and the condition of fluid flow in the tubing caused by the pressure and temperature of the fluid and caused by buckling if it is present is determined. An output indicates the change in length of the tubing and the stress applied to the tubing.

10 Claims, 7 Drawing Figures

$Fa_2 = Fa_1 - WL$ $Fa_2 = Fa_1 - WL \cos \theta$

DETERMINING STRESSES AND LENGTH CHANGES IN WELL PRODUCTION TUBING

BACKGROUND OF THE INVENTION

This invention relates to the production and stimulation of oil wells and more particularly, to a method of determining the length change of a string of tubing in an inclined well.

Gas wells and flowing oil wells are usually completed and treated through a string of tubing and a packer. Changes in temperature and pressure during stimulation and production of a well usually result in changes in tubing length, tubing stress, and packer load. These changes in tubing length and stress are quite substantial especially in deep high temperature, high pressure wells. Costly failure occurs if the stresses exceed the tubing mechanical strength, or if the seal length is inadequate to compensate for the length change. If the fluid pressure inside the tubing is much greater than that outside, the tubing may buckle helically, even if there is packer-to-tubing tension.

The forces acting on a tubing string which undergoes changes in temperature and in pressure, and a study of helical buckling is contained in "Helical Buckling of Tubing Sealed in Packers," A. Lubinski, W. S. Althouse and J. L. Logan, *Petroleum Transactions* June 1962, pp. 655–670. This study is extended to combination completions having varying tubing and/or casing sizes in "Movement, Forces and Stresses Associated With Combination Tubing Strings Sealed in Packers," D. J. Hammerlindl, February, 1977, *J. of Pet. Tech.*, pp. 195–208. "Tubing Movement, Forces, and Stresses in Dual Flow Assembly Installations," Kenneth S. Durham, SPE 9265, Paper presented at the 55th Annual Fall Technical Conference of the Society of Petroleum Engineers of AIME, Dallas, Texas, Sept. 21–24, 1980, extends the study to situations involving dual flow assembly installations.

The present invention is an improvement on the techniques discussed in the foregoing prior art. More particularly, the present invention is an improvement which can be used in sharply inclined wells where buckling may or may not occur, depending on the forces which are applied to the tubing string. The presence or absence of buckling is an important component of length change. The present invention provides an improvement in the accuracy in the determination of length change because it determines whether or not buckling has occurred.

RELATED APPLICATIONS

"Preventing Buckling In Drill String", Dellinger, Gravley and Walraven, Ser. No. 292,061, filed Aug. 11, 1981, discloses the determination of the buckling of a drill string, 20 and more particularly, discloses the criteria for developing the threshold for buckling. This is incorporated herein by reference.

SUMMARY OF THE INVENTION

In accordance with the present invention, the length change of a string of tubing in a well caused by fluid flow through tubing during production or stimulation of the well is determined by using the inclination of successive sections of the tubing string to resolve the weight of each section into the axial component applied to the next successive segment. This axial component is combined with the actual force applied to each of the tubing segments from fluid pressure acting upon the cross-sectional area of the tubing. For each of the successive sections, the buckling force is determined from the actual force and from the axial component of weight. This buckling force is compared to a threshold to determine if there is buckling of the tubing string. The length change of the tubing between the initial condition and the condition of fluid flow in the tubing caused by pressure and temperature of the fluid and caused by buckling if it is present, is determined. An output indicating the change in the length of the tubing and the stress applied to the tubing is produced.

In accordance with another aspect of the present invention, an improvement in the determination of length change of the tubing due to radial pressure forces over that shown in the aforementioned Hammerlindl reference, is obtained by separately determining the length change caused by the ballooning effect and the length change caused by the fluid frictional drag due to flow.

The foregoing and other objects, features and advantages of the invention will be better understood from the following more detailed description and appended claims.

SHORT DESCRIPTION OF THE DRAWINGS

FIG. 1 shows an inclined well with a tubing string to which the present invention is applicable;

FIGS. 2A and 2B together show a flow sheet of the present invention;

FIGS. 3A and 3B show the force and resolved weight acting on one segment of a tubing string in a vertical and an inclined well respectively;

DESCRIPTION OF THE PREFERRED EMBODIMENT

Figure 1:
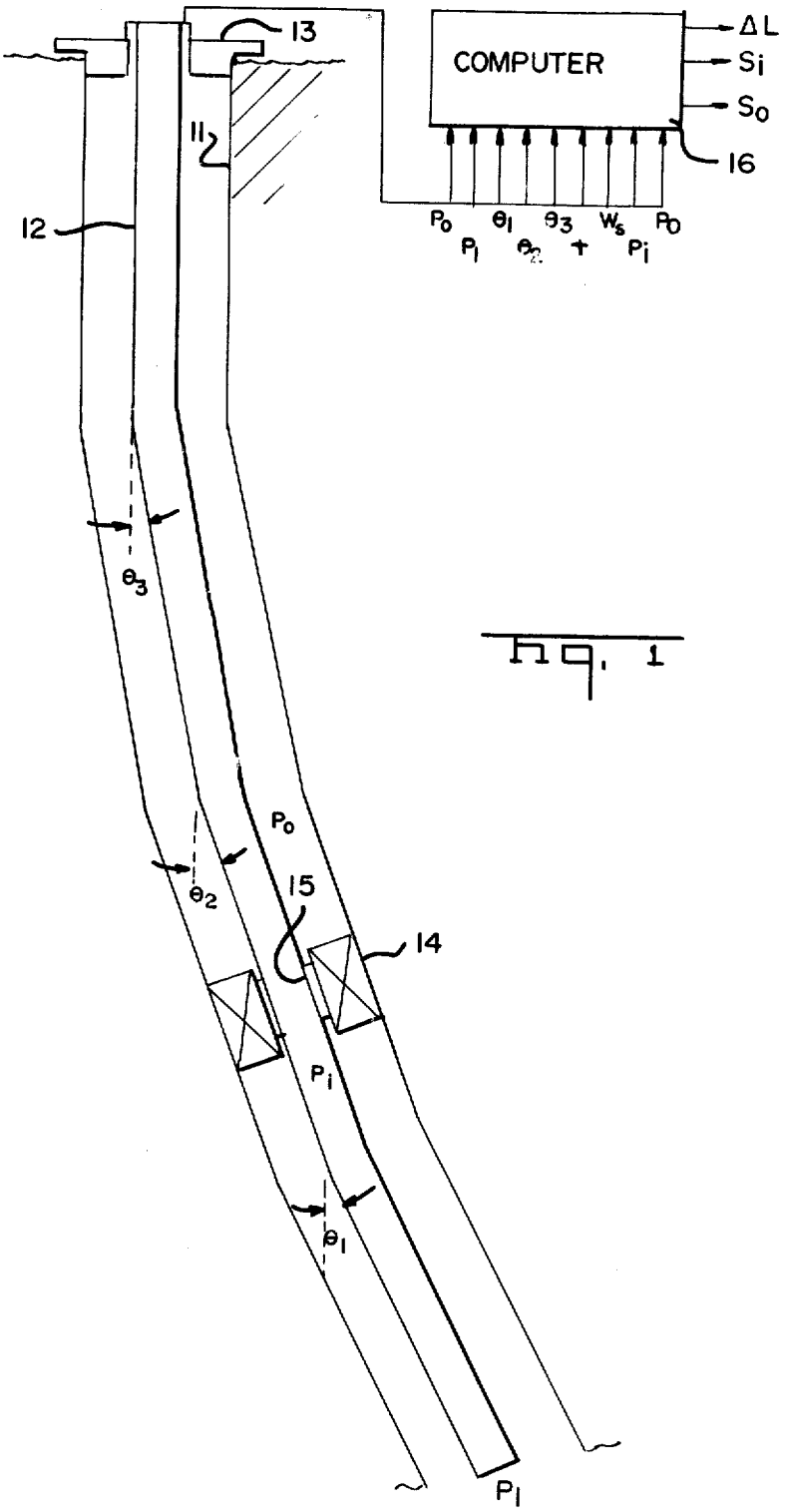

FIG. 1 shows an inclined well having a casing 11 and a string of tubing 12 which extends through the annulus 13 at the surface of the well. A packer 14 and a seal 15 on the casing separate the formation pressure $P_1$ from the casing pressure $P_0$. Normally, the casing outside of the tubing is filled with casing fluid, the pressure of which at any depth is directly related to the hydrostatic head. The formation pressure $P_1$ is known from surveys. In accordance with the present invention, it is assumed that the string of tubing is made up of a number of sections, each having an inclination $\theta_1$, $\theta_2$, and $\theta_3$ and so on.

During normal production, fluids or hot gas under formation pressure enter the bottom of the string of tubing 12. During stimulation, the flow is in the opposite direction with high pressure steam, or relatively cold acid entering the string of tubing at the surface. Changes in temperature and pressure during stimulation or production of a well result in changes in tubing length, tubing stress and load on the packer 14. Changes may be substantial and may result in failure of the system. For example, if the change of length of a tubing string is greater than the length of the seal 15, the pressure seal will be lost. If the stress on the tubing string is greater than its capability to withstand stress, fracturing of the tubing will occur. In accordance with the present invention, computer 16 produces an output $\Delta L$ indicating change in the length of the tubing and outputs $S_0$ and $S_i$ representing the combined stresses on the tubing. By monitoring these outputs, failure of an operating system can be prevented. Alternatively, the present invention can be used to simulate an operating well to provide the engineer with design criteria.

Change in length of the string of tubing is caused by several factors. The formation pressure acting on the cross-sectional area of the tubing exerts a compressive force in accordance with Hooke's law. A temperature change causes a change in length of the tubing dependent upon the thermal coefficient of expansion of the tubing material. Fluid flow through the tubing causes a length change due to the frictional drag of the fluid on the walls of the tubing. It has been found that difference in pressure also induces a length change caused by ballooning (or contraction) of the diameter of the tubing. That is, high pressure inside the tubing will cause ballooning of the tubing which shortens the length; conversely, high pressure outside the tubing contracts its diameter and lengthens the tubing. Finally, a very significant change in length occurs depending upon whether or not there is buckling of the string of tubing. This is of particular concern in inclined wells to which the present invention is directed because sometimes the string of tubing buckles, and at other times it does not. The present invention determines length change of a string of tubing in an inclined well.

Figure 2A:
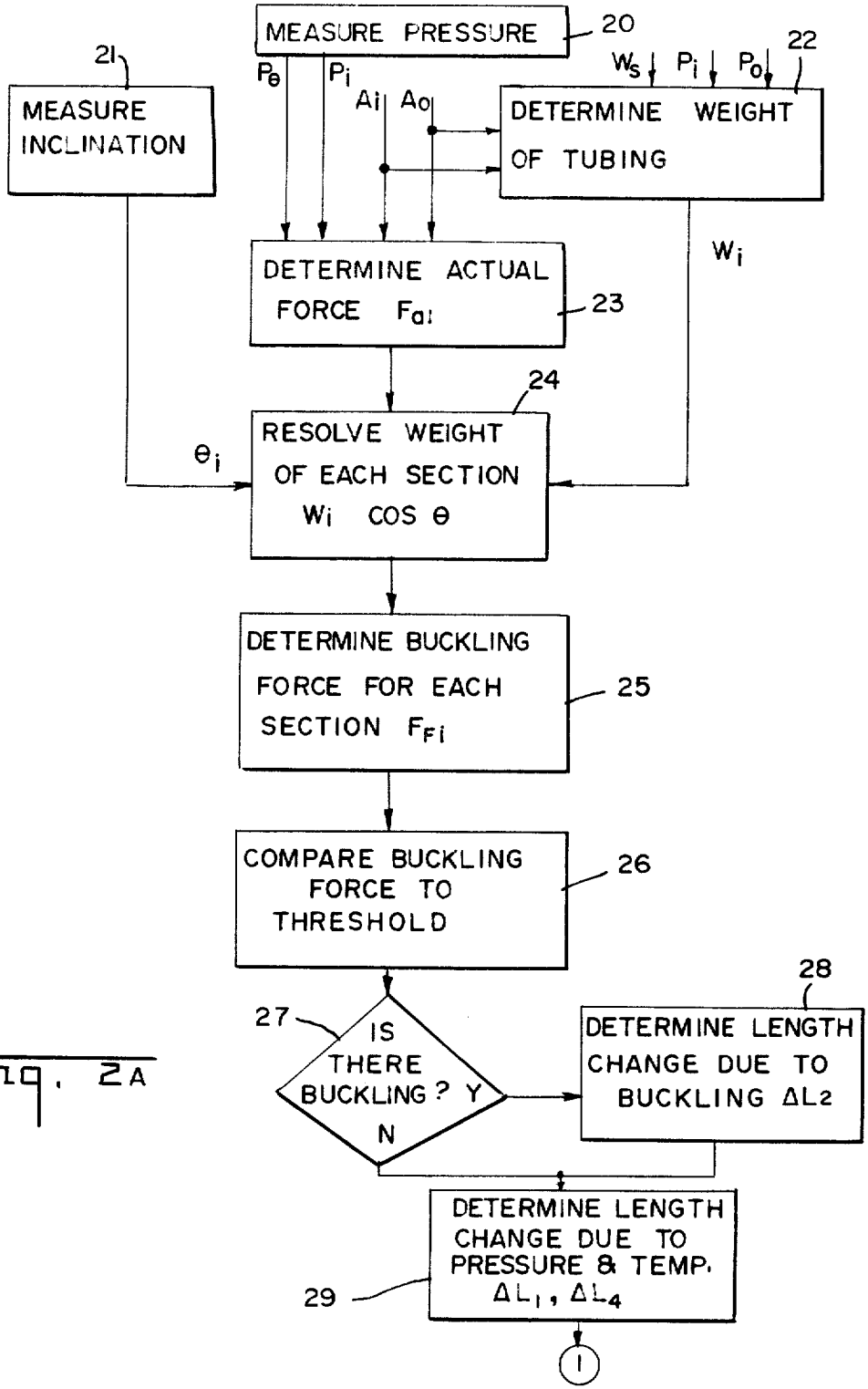
Figure 2B:
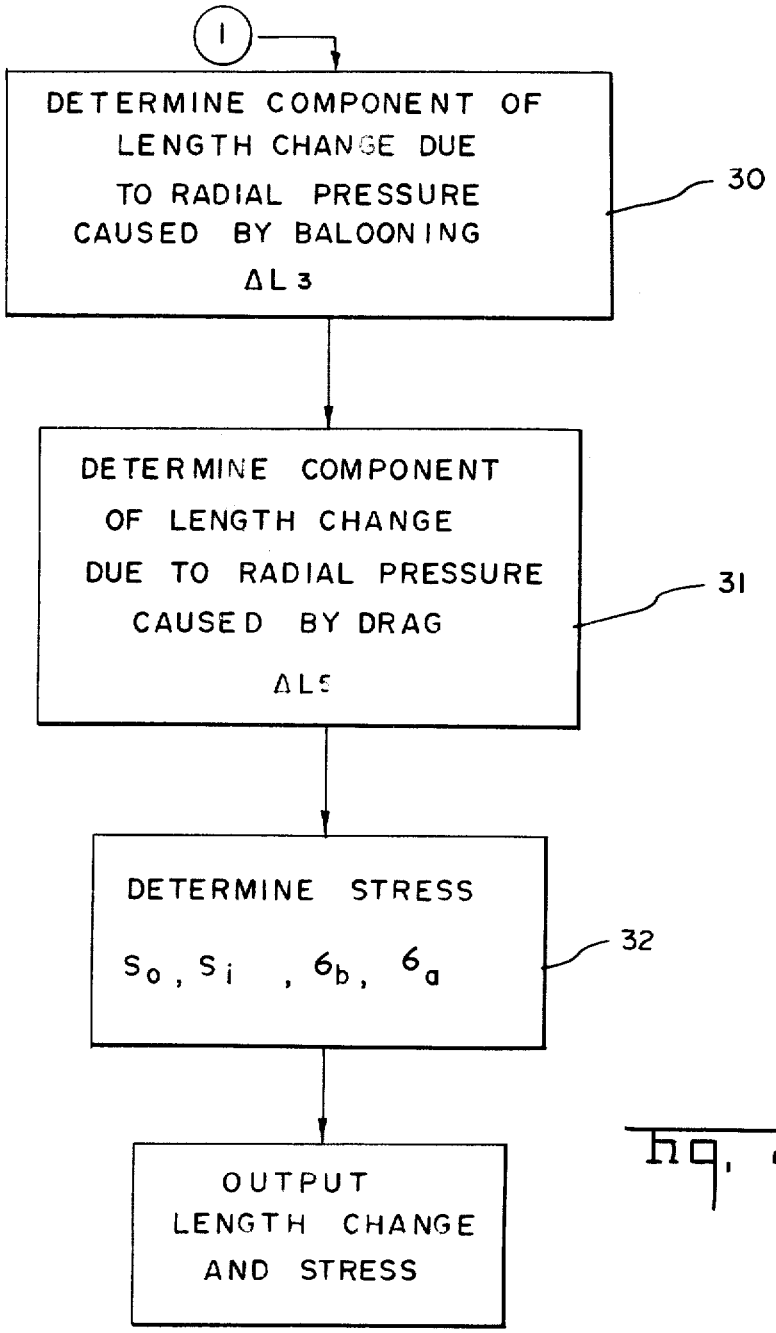
Figure 7A:
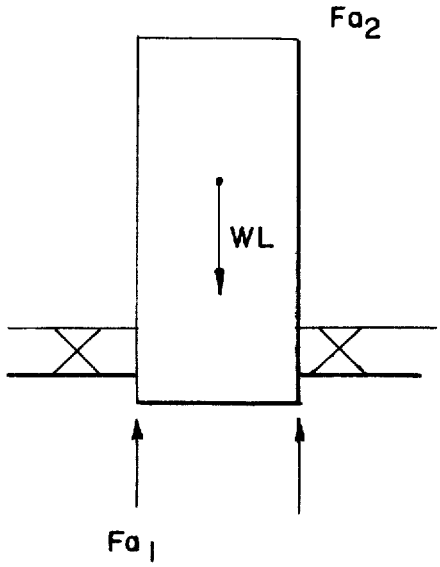
Figure 7B:
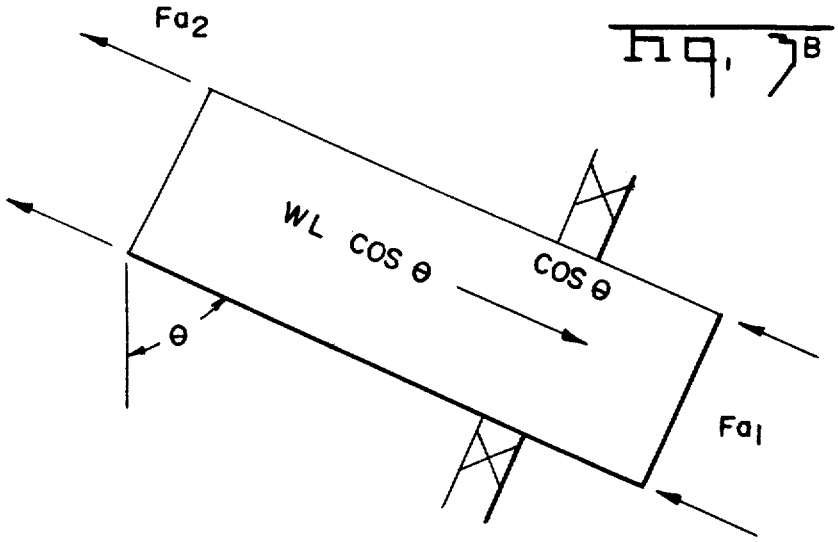

The invention is depicted in the flow chart of FIGS. 2A and 2B. The following nomenclature will be used in describing the invention.

$A_i$—Area corresponding to tubing ID
$A_o$—Area corresponding to tubing OD
$A_p$—Area corresponding to packer-bore ID
$A_s$—Cross-sectional area of the tubing wall
D—OD of the tubing
E—Young's modulus (for steel, $E=30\times10^6$ psi)
F—Force (positive if a compression)
$F_a$—Resultant actual force at the lower end of tubing, resulting from pressures and packer restraint
$F_f$—Resultant fictious force in presence of packer restraint
$F_p$—Packer-to-tubing force
$F_{fr}$—Fluid friction drag
I—Moment of inertia of tubing cross-section with respect to its diameter: $I=\pi/64\ (D^4-d^4)$, where D is OD and d is ID
L—Length of tubing, $L_1$=length of Section 1, $L_2$=length of Section 2, etc.
$\Delta L_1$=Length change of the tubing due to Hooke's law
$\Delta L_2$—Length change of the tubing due to helical buckling
$\Delta L_3$—Length change of the tubing due to radial pressure forces
$\Delta L_4$—Length change of the tubing due to temperature change
$\Delta L_5$—Length change of the tubing due to fluid flow through the tubing
$P_i$—Pressure inside the tubing
$P_o$—Pressure outside the tubing
$\Delta P_o$—Change in pressure outside the tubing
$\Delta P_i$—Change in pressure inside the tubing
r—Tubing-to-casing radial clearance
R—Ratio OD/ID of the tubing
W—Weight per unit length, in air, same as $W_s$; in liquid, W is given by the equation for Wi herein.
$\beta$—Coefficient of thermal expansion of the tubing material (for steel, $=6.9\times10^6/1°$ F.)
$\delta$—Pressure drop in the tubing due to flow per unit length, psi/1000 ft.
$\Delta t$—Change in average tubing temperature
$\rho_i$—Density of liquid in the tubing
$\rho_o$—Density of liquid in the annulus
$\Delta\rho_i$—Change in density of liquid in the tubing
$\Delta\rho_o$—Change in density of liquid in the annulus
$\mu$—Poisson's ratio of the material (for steel, $\mu=0.3$)
$\sigma_a$—Normal axial stress (i.e., $F/A_s$)
$\sigma_b$—Bending stress at the outer fiber
$S_i$—Combined stress at inner wall of tubing
$S_o$—Combined stress at outer wall of tubing
$\theta$—Angle of inclination Referring now to FIGS. 2A and 2B the pressure inside the tubing $P_i$ and the pressure outside the tubing $P_0$ form inputs as indicated by the step 20. These pressures are determined from the measured formation pressure $P_1$, known from a survey for example, and from the measured fluid pressure beneath the annulus and the hydrostatic head of the casing fluid. As indicated at 21, the inclination of the sections of the tubing string, $\theta_1$, $\theta_2$, $\theta_3$, are determined from a well survey. As indicated at 22, the weight $W_i$ of each section of tubing in the mud is determined from the weight of the tubing section in air, $W_s$, and from the mud density under the initial condition and under the final condition, $\rho_0$ and $\rho_i$, respectively and from the inside and outside cross-sectional areas of the tubing, $A_i$, $A_o$. The weight of each section is determined in accordance with:

$$W_i=(W_s+P_iA_i-P_oA_o)_i$$

As indicated at 23, the actual force on the bottom of the drill string due to pressure is determined in accordance with $$F_{a1}=(A_p-A_{i1})P_{i1}-(A_p-A_{o1})P_{o1}+F_p$$

The actual force at the bottom of the string is equal to the inside pressure multiplied by the difference in packer bore area and the inside cross section area, minus the outside pressure multiplied by the difference in packer bore areas and the outside cross section area. To this is added the weight supported by the packer, $F_p$, which is commonly referred to as the slack-off weight.

In order to determine the actual force applied to successive sections of the tubing string, the weight on each section must be resolved into the component acting axially along the tubing string. This step is indicated at 24. This can best be explained with reference to FIGS. 3A and 3B. Assume first that the tubing string is vertical as shown in FIG. 3A and that the section has a weight LW. (W is weight per unit length, e.g. lb per foot therefore the weight of the string is WL). The actual force applied to the bottom of the section is $F_{a1}$. The force applied to the next successive section is:

$$F_{a2}=F_{a1}-WL$$

On the other hand, when the tubing string is inclined as shown in FIG. 3B, the force applied to the next succeeding section will be:

$$F_{a2}=F_{a1}-WL\cos\theta$$

After the weight of each section has been resolved into its axial components, the buckling force $F_{fi}$ for each successive section can be determined as indicated at 25. The force on each section in the presence of a restraint by the packer, has been referred to in the literature as the "fictious force". This force is $$F_{fi}=F_{fi-1}-(LW\cos\theta)_{i-1}$$

Whether or not there is buckling of each section is determined by comparing this buckling, or fictious, force to a threshold as indicated by the step 26. The threshold is a critical force $F_{cr}$ which is given by:

$$F_{cr}=2.93\,(EIW^2)^{\frac{1}{4}}\left[\left(\frac{EI}{W}\right)^{\frac{1}{2}}\frac{\sin\theta}{r}\right]^{.436}$$

The manner in which this threshold is developed is more fully explained in the aforementioned Dellinger, Gravley and Walraven application.

In accordance with step 27, if the buckling force applied to a section is greater than a threshold, determination of length change due to buckling is made. This step is indicated at 28. Where buckling is present, the resultant length change in the tubing is:

$$\Delta L_2=-\sum_{i=1}^{m}\left\{\frac{r^2}{8EIW\cos\theta}\,[LW\cos\theta\,(2F_f-LW\cos\theta)]\right\}_i-\left(\frac{r^2F_f^2}{8EIW\cos\theta}\right)_{m+1}$$

The length changes due to temperature and pressure are determined as indicated at 29. These length changes are:

$$\Delta L_1=-\sum_{i=1}^{k}\left(\frac{L}{EA_s}F_a\right)_i$$

$$\Delta L_4=\sum_{i=1}^{k}(\beta\Delta tL)_i$$

Referring now to FIG. 2B, the determination of length change due to radial pressure is divided into two steps. First, as indicated by step 30, the component caused by ballooning is determined in accordance with:

$$\Delta L_{3(Ballooning)}=-\sum_{i=1}^{k}\left(\frac{\mu}{E}\,\frac{(P_{ii}+P_{ii+1})-R^2(P_{0i}+P_{0i+1})}{R^2-1}L\right)_i$$

In the step indicated at 31, the component of length change caused by fluid frictional drag is determined from:

$$\Delta L_{5(Fluid\ Frictional\ Drag)}=-\sum_{i=1}^{k}\left(\frac{L}{2EA_s}(F_{fri}+F_{fri+1})\right)$$

Next, the combined stresses on the string of tubing are determined as indicated by the step 32. These stresses are based on maximum-distortion-energy theory as follows:

$$S_0=\sqrt{3\left(\frac{P_i-P_0}{R^2-1}\right)^2+\left(\left|\left(\frac{P_i-R^2P_0}{R^2-1}+\sigma_a\right)\right|+|\sigma_b|\right)^2}$$

$$S_i=\sqrt{3\left(\frac{R^2(P_i-P_0)}{R^2-1}\right)^2+\left(\left|\left(\frac{P_i-R^2P_0}{R^2-1}\right)+\sigma_a\right)\right|+\left|\frac{\sigma_b}{R}\right|\Bigg)^2}$$

$$\sigma_b=\frac{Dr}{4I}F_f$$

$$\sigma_a=\frac{F_a}{A_s}$$

An example of a computer program for carrying out the invention on a Control Data Corporation Computer, Model No. 750 is included in the appendix. This is but one example of programming which can be used to carry out the invention.

Figure 4:
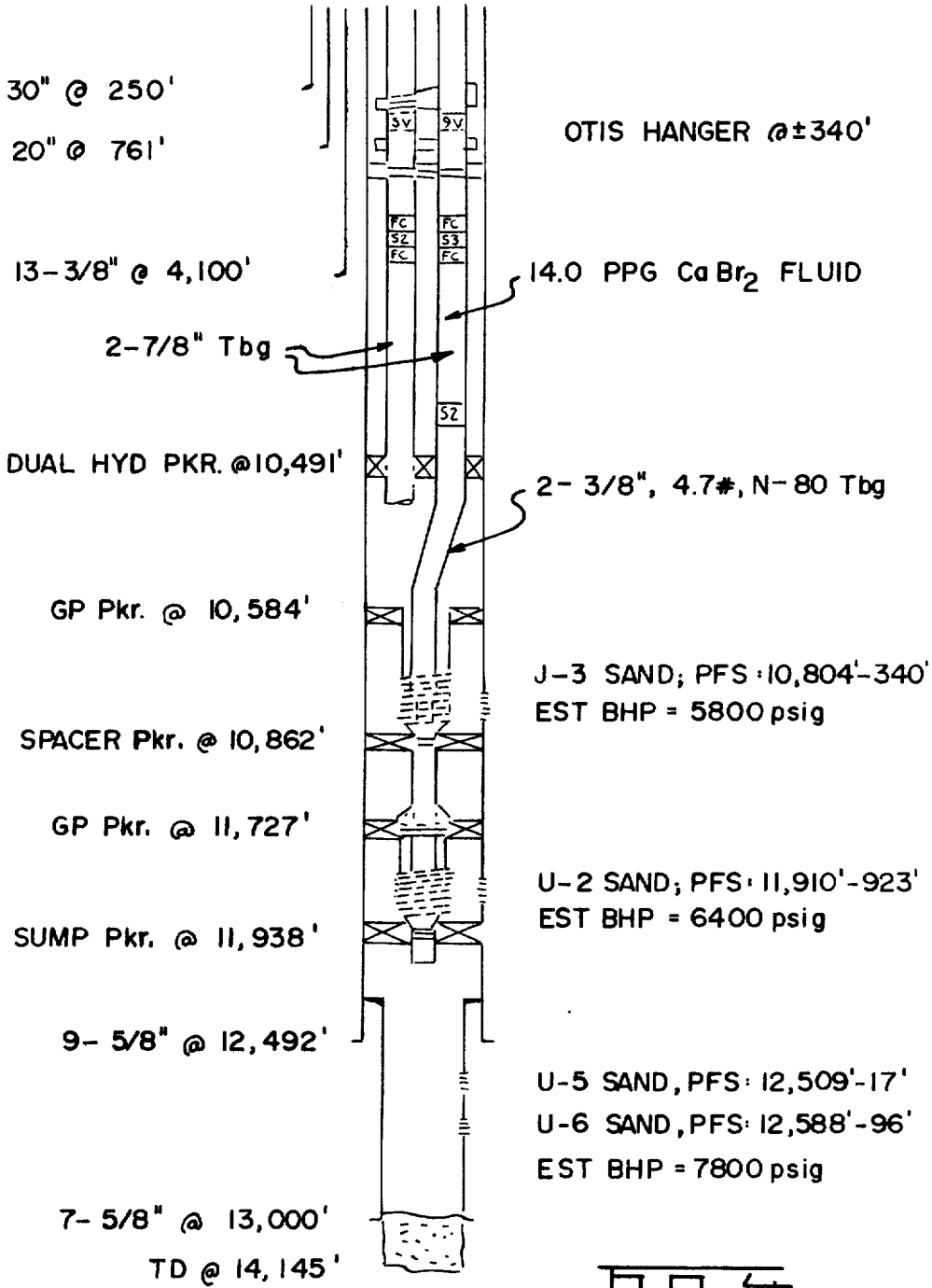
FIG. 4 shows a well which was used in an example of the performance of the invention.
Figure 5:
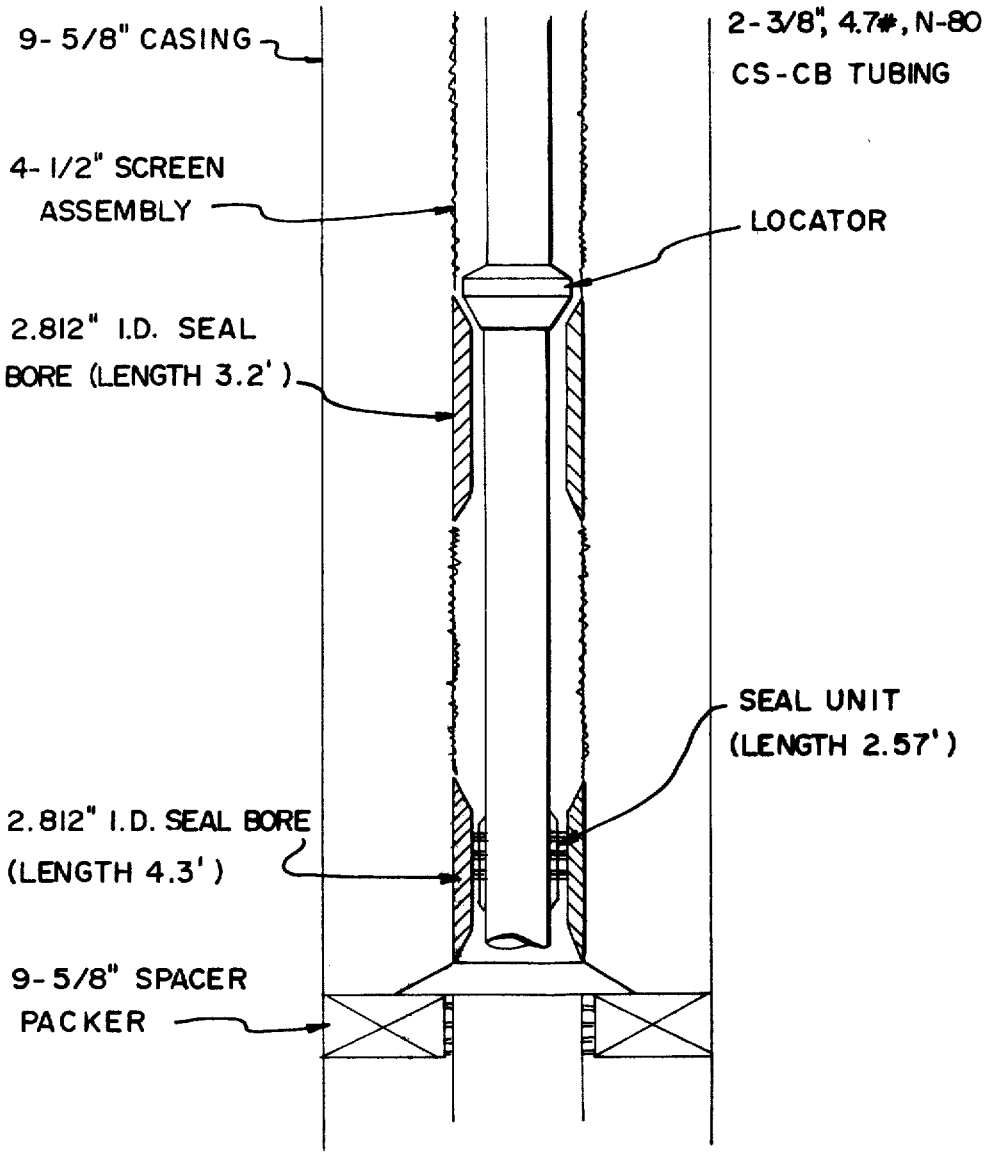
FIG. 5 shows more details of the seal unit and receptacle of the well of FIG. 4.

The operation of the invention will be better understood from its application to an actual example. The example is a dual completion well shown in FIG. 4. During the short string completion test, the well developed communication between the long string and the short string completions. When the failure occurred, the long string was full of 14.0 lb/gal $CaBr_2$ fluid and the short string was producing 8 MMSCFD of gas with an estimated flowing bottom hole pressure at the seal of 3700 psig. The present invention was used to analyze the failure. The following inputs were provided.

1. Packer type number is 2; packers permitting limited motion. Packer bore ID is 2.812". Assume a slack off weight of 5,000 lb.
2. Assume a vertical hole. Assume the surface is at the dual hydraulic packer. The packer depth is therefore 10862-10491=371'.
3. Tubing sizes: ID-1.995", OD-2.375", Weight=4.7 #/ft., MD=371'.
4. Casing ID: Use 47 #/ft. with an ID of 8.681" for the 9⅝" casing and 4" ID for the screen assembly.
   a. ID=8.681", MD=10584−10491=93'
   b. ID=4.00", MD=371'
5. Fluids
   a. Initial condition
      Casing=14 ppg
      Tubing=14 ppg
   b. Present condition
      Casing=1.5 ppg (0.7 gravity gas @ 3700 psig and 210° F.)
      Tubing=14 ppg
6. Surface Pressure
   a. Initial completion condition
      Surface pressure for both tubing and casing (@ dual hydraulilc packer)=14×10491×0.052=7637 psig
   b. Present condition
      Tubing surface pressure=7637 psig Casing surface pressure = 3700 − 371 × 1.5 × 0.052 = 3671 psig 7. Temperature a. Initial condition: 210° F.

b. Present condition: 210° F.

8. Fluid frictional pressure loss: assume zero. The output is shown below.

(The input and output print out are shown on the following page.)

INPUT INFORMATION

PACKER TYPE NO.= 2
PACKER BORE ID= 2.8120 IN.
INITIAL AVERAGE TEMPERATURE= 210.00 F.
INITIAL TUBING HEAD PRESSURE= 7637.00 PSI;
INITIAL CASING HEAD PRESSURE= 7637.00 PSI;
INITIAL SLAOFF= 5000.00 LB.
YOUNG'S MODULUS= .30DE+08 PSI
POISSON'S RATIO= .30
COEFF. OF THERMAL EXPANSION= .690E-05 /1 F.

PRESENT AVERAGE TEMPERATURE= 210.00 F.
PRESENT TUBING HEAD PRESSURE= 7637.00 PSI;
PRESENT CASING HEAD PRESSURE= 3671.00 PSI;

| MD,FT. | TVD,FT. | ANGLE OF INCLI-NATION DEGREE | CSG ID,IN. | TBG OD,IN. | TBG ID,IN. | INITIAL CSG FLUID LB/GAL | PRESENT CSG FLUID LB/GAL | INITIAL TBG FLUID LB/GAL | PRESENT TBG FLUID LB/GAL | TBG WT. LB/FT. | PRESENT FRICTION GRAD., PSI/1000FT |
|---|---|---|---|---|---|---|---|---|---|---|---|
| 0.00 | 0.00 | | | | | | | | | | |
| 93.00 | 93.00 | 0.00 | 8.681 | 2.375 | 1.995 | 14.00 | 1.50 | 14.00 | 14.00 | 4.70 | 0.000 |
| 371.00 | 371.00 | 0.00 | 4.000 | 2.375 | 1.995 | 14.00 | 1.50 | 14.00 | 14.00 | 4.70 | 0.000 |

S.P.-10 NO.6 CASE NO. 1

PACKER PERMITTED LIMITED MOTION.

LENGTH CHANGED= -4.39 IN.
(NEGATIVE-SHORTENING, POSITIVE-LENGTHENING)

MINIMUM SEAL LENGTH REQUIRED= 4.39 IN. + LENGTH OF ONE SET OF SEAL ELEMENTS.

MAXIMUM COMBINED STRESS= 78397.03 PSI, AT MD= 93.00 FT.
(MAXIMUM COMBINED STRESS SHOULD NOT EXCEED 80% OF THE MINIMUM YIELD.)

PACKER TO TUBING FORCE= 0.00 LB.
INITIAL SLAOFF= 5000.00 LB.
(POSITIVE-COMPRESSION, NEGATIVE-TENSION)

NEUTRAL POINT AT MD= 0.00 FT.

DETAILED OUTPUT

| SECTION BETWEEN MD,FT. | AND MD,FT. | LENGTH CHANGE-PISTON IN. | LENGTH CHANGE-BUCKLING IN. | LENGTH CHANGE-BALLOON-ING,IN. | LENGTH CHANGE-FRICTION IN. | LENGTH CHANGE-TEMPERA-TURE,IN. | PRESENT ABSOLUTE LENGTH CHANGE-BUCKLING IN. | COMBINED STRESS AT INNER WALL, PSI TOP OF SECTION | BOTTOM OF SECTION | COMBINED STRESS AT OUTER WALL, PSI TOP OF SECTION | BOTTOM OF SECTION |
|---|---|---|---|---|---|---|---|---|---|---|---|
| 0.00 | 93.00 | -.07 | -2.38 | -.30 | 0.00 | 0.00 | -2.53 | 69633.29 | 73266.91 | 76444.13 | 78197.03 |
| 93.00 | 371.00 | -.21 | -.49 | -.93 | 0.00 | 0.00 | -.59 | 59149.56 | 61880.72 | 57491.78 | 60106.53 |
| | TOTAL | -.28 | -2.87 | -1.24 | 0.00 | 0.00 | -3.42 | | | | |

| SECTION BETWEEN MD,FT. | AND MD,FT. | AXIAL FORCE, LB. TOP OF SECTION | BOTTOM OF SECTION | PRESSURE, PSIG. AT BOTTOM OF SECTION TUBING | ANNULUS |
|---|---|---|---|---|---|
| 0.00 | 93.00 | 16059. | 16496. | 7704.70 | 3676.25 |
| 93.00 | 371.00 | 16496. | 17803. | 7907.09 | 3699.94 |

The following conclusions can be drawn from the program output:

1. The tubing only shortened by 4.4 inches. The seal unit length is 2.57', therefore the communication between the short and long string was not caused by the seal movement.

2. The section of the tubing inside the 4½" screen assembly between 10584' and 10862' measured depths had combined stresses well below 80% of the minimum yield. No tubing failure would occur in this section. The minimum yield for N-80 tubing is 80,000 psi.

3. The combined stresses for the section of the tubing between 10491' and 10584' measured depths were well above 80% of the minimum yield. The whole section would be permanently corkscrewed, though not necessarily ruptured. Since there was a communication between the short string and long string and the communication was not caused by seal movement, this section of tubing was concluded to be ruptured or parted at its weakest point somewhere between 10491' and 10584'. The weakest point is not necessarily, though likely, at the point where the calculated combined stress is highest. Remember that the combined stress is calculated based on uniform wall thickness. The actual wall thickness might be thicker or thinner and the actual yield strength might also be higher than the minimum yield at that particular point.

When the production assembly was pulled, it was found that the 2⅜" tubing was badly corkscrewed between the top of the short string GP packer and the dual hydraulic packer, and the joint of tubing directly below the dual hydraulic packer was ruptured and had parted. This agreed with the conclusions based on the program output.

The following alternatives could be used to avoid the failure:

1. Limit the pressure differential across the seal to 3,000 psi by limiting the drawdown during the completion test.

2. Upgrade the 2⅜" N-80 tubing to P-110.

3. Use a string of 2⅜", N-80 blast joints or a string of 2⅜", N-80, 5.95 lb/ft. tubing between the dual hydraulic packer and the GP packer.

While a particular embodiment of the invention has been shown and described, various modification are within the true spirit and scope of the invention. The appended claims are, therefore, intended to cover all such modifications.

APPENDIX "A"

V. PROGRAM INPUT

A. Input Information

The program requires the following input information:

1. Packer Type

Three types of packers are allowed. They are designated by the numbers 1, 2 and 3: (1) for packers permitting free motion, (2) for packers permitting limited motion, and (3) for packers permitting no motion.

2. Wellbore Deviation

Divide the wellbore into a number of straight line sections with different angles of inclination. For a vertical well, only one section is needed. For most inclined wells, two or three sections are usually needed. Obtain the measured depths and the corresponding vertical depths at the end point of each section. For completions with subsurface tubing hangers, set the zero measured and vertical depths at the subsurface hanger. Then reset the measured and vertical depths of each section accordingly.

3. Tubing Dimensions and Depths

Separate the tubing into a number of sections with different tubing sizes. Record the tubing ID, OD, weight and measured depth of each section. For completions with subsurface tubing hangers, reset the measured depths as outlined above.

4. Casing ID and Depth

Record the casing ID and the liner ID, if any, with their measured depths.

5. Well Fluids

Record the density in lb/gal of the fluids on both the annulus and tubing at the initial completion condition and the present condition. If there is more than one fluid in the annulus and/or tubing, note the measured depths at the interface between the two different fluids. The present condition is the situation of the well at which the tubing stresses and movements will be calculated. It could be a stimulation, or normal production cycles, or even the initial completion condition if the tubing stresses at initial completion condition are to be calculated.

6. Surface Pressure

Record the annulus and tubing surface pressures at the initial completion and present conditions. For completion with subsurface tubing hangers, use the pressures at the subsurface hanger as the surface pressures.

7. Average Temperature

The average temperatures at the initial completion and present conditions are required.

8. Packer Bore I.D. and Slack Off Weight

Record the slack off weight and the I.D. of the packer seal bore.

9. Fluid Frictional Drag

The frictional pressure loss (psi/1000 ft) of the fluid flowing inside the tubing string is required. The frictional pressure loss is negative for upflow and positive for downflow, or assumed zero when this information is not available.

B. Input Format

The Fortran program listed hereafter was written with batch type input. An input format as described below is necessary.

Thirteen types of data input cards are required. These cards should be in the exact sequence as they are numbered. All numeric values except the card number should have decimal points.

1. Card Type 1: Case Name

| | |
|---|---|
| Column 1-6 | "I NAME" |
| Column 11-40 | Any case name with 30 characters or less |

2. Card Type 2: Wellbore Deviation a. Card 2A

| | |
|---|---|
| Column 1-7 | "2A DEVN" |
| Column 11-20 | Number of pairs of vertical and measured depths used to describe the wellbore deviation |

b. Card 2B

| | |
|---|---|
| Column 1-7 | "2B DEVN" |
| Column 11-20 | Vertical depth, ft. |
| Column 21-30 | Measured depth, ft. |
| Column 31-40 | Vertical depth, ft. |
| Column 41-50 | Measured depth, ft. |
| Column 51-60 | Vertical depth, ft. |
| Column 61-70 | Measured depth, ft. |

Use as many type 2B cards as necessary. Be sure to fill up the card with three pairs of measured and vertical depths before going to the next card. For example, five pairs of vertical and measured depths will need two type 2B cards. The first card contains three pairs of data, the second card contains the remaining two pairs of data. Use the same guideline to prepare data cards for Card Type 3, 6, 7, 9, 10, and 11. The first pair of vertical and measured depths must be a pair of zeros. Subsequent data pairs must be arranged in the order of increasing depth.

-continued

APPENDIX "A"

V. PROGRAM INPUT

3. Card Type 3: Casing ID a. Card 3A

| | |
|---|---|
| Column 1-6 | "3A CSG" |
| Column 11-20 | Number of different casing ID |

b. Card 3B

| | |
|---|---|
| Column 1-6 | "3B CSG" |
| Column 11-20, 31-40, 41-60 | Casing ID, in. |
| Column 21-30, 41-50, 61-70 | Measured depth, ft. |

Input the casing ID in the order of increasing depth. The last measured depth must be exactly equal to the packer setting depth.

4. Card Type 4: Tubing Size a. Card 4A

| | |
|---|---|
| Column 1-6 | "4A TBG" |
| Column 11-20 | Number of different tubing sizes |

b. Card 4B

| | |
|---|---|
| Column 1-6 | "4B TBG" |
| Column 11-20 | Tubing ID, in. |
| Column 21-30 | Tubing OD, in. |
| Column 31-40 | Tubing weight, lb/ft. |
| Column 41-50 | Measured depth, ft. |

Use as many type 4B cards as necessary. Arrange them in the order of increasing depth. The last measured depth must be exactly equal to the packer setting depth.

5. Card Type 5: General

| | |
|---|---|
| Column 1-6 | "5 IGEN" |
| Column 11-20 | Packer type number |
| Column 21-30 | Packer seal bore ID, in. |
| Column 31-40 | Initial average temperature, °F. |
| Column 41-50 | Slack off weight, lb. |
| Column 51-60 | Initial tubing surface pressure, psig |
| Column 61-70 | Initial casing surface pressure, psig |

6. Card Type 6: Initial Casing Fluid a. Card 6A

| | |
|---|---|
| Column 1-8 | "6A ICFLD" |
| Column 11-20 | Number of different casing fluids at initial completion condition |

b. Card 6B

| | |
|---|---|
| Column 1-8 | "6B ICFLD" |
| Column 11-20, 31-40, 51-60 | Fluid density, lb/gal |
| Column 21-30, 41-50, 61-70 | Measured depth, ft. |

Enter the fluid densities in the order of increasing depth. The last measured depth must be exactly equal to the packer setting depth.

7. Card Type 7: Initial Tubing Fluid a. Card 7A

| | |
|---|---|
| Column 1-8 | "7A ITFLD" |
| Column 11-20 | Number of different tubing fluids at initial condition |

b. Card 7B

| | |
|---|---|
| Column 1-8 | "7B ITFLD" |
| Column 11-20, 31-40, 51-60 | Fluid density, lb/gal |
| Column 21-30, 41-50, 61-70 | Measured depth, ft. |

8. Card Type 8: General

| | |
|---|---|
| Column 1-6 | "8 PGEN" |
| Column 11-20 | Present average temperature, °F. |
| Column 21-30 | Present tubing surface pressure, psig |
| Column 31-40 | Present casing surface pressure, psig |

9. Card Type 9: Present Casing Fluid a. Card 9A

| | |
|---|---|
| Column 1-8 | "9A PCFLD" |
| Column 11-20 | Number of different casing fluid at present condition |

b. Card 9B

| | |
|---|---|
| Column 1-8 | "9B PCFLD" |
| Column 11-20, 31-40, 51-60 | Fluid density, lb/gal |

-continued

APPENDIX "A"

V. PROGRAM INPUT

Column 21-30, 41-50
61-70 Measured depth, ft.

10. Card Type 10: Present Tubing Fluid
a. Card 10A
Column 1-9 "10A PTFLD"
Column 11-20 Number of different tubing fluids.
b. Card 10B
Column 1-9 "10B PTFLD"
Column 11-20, 31-40
51-60 Fluid density, lb/gal
Column 21-30, 41-50,
61-70 Measured depth, ft.

11. Card Type 11: Frictional Pressure Loss
a. Card 11A
Column 1-8 "11A FRIC"
Column 11-20 Number of different values of frictional pressure loss
b. Card 11B
Column 1-8 "11B FRIC"
Column 11-20, 31-40,
51-60 Frictional pressure loss, psi/1000 ft.
Column 21-30, 41-50,
61-70 Measured depth, ft.

12. Card Type 12: Continuation
Column 1-7 "12 CONT"
This card tells the program to use the same data from Card Type 1 through 4 for the next case. It should be followed by card type 5. Do not use card type 13.

13. Card Type 13: End
Column 1-6 "13 END"
This card must follow card type 11 if card type 12 is not used. It is followed by either card type 1 or end of job card.

APPENDIX B

```
      PROGRAM TBGSTR(INPUT,OUTPUT,TAPE9)
      DIMENSION TVDH(9),MDH(9),CSGID(5),CSGMD(5),TBGID(5),
     1TBGOD(5),WTBG(5),TBGMD(5),FGSMD(5),FDCI(5),
     1FDCMDI(5),FDTI(5),FDTMD(5),FDCF(5),FDCMDF(5),
     1FDTI(5),FDTMDF(5),FGS(5),SMD(45),STBGID(45),STBGOD(45),
     1STVD(45),SWTBG(45),SWE(45),SFDC(45),SFDT(45),SFGS(45),
     1SCSGID(45),SANG(45),SCHP(45),STHP(45),SAD(45),SAI(45),
     1SER(45),SIN(45),SDL(45),XL1I(45),XL2I(45),XL3I(45),XL4I(45),
     1SAS(45),SRR(45),FA(45),FF(45),FFR(45),XL1F(45),XL2F(45),
     1XL3F(45),XL4F(45),XL5F(45),IA(80),DD(5),STRD(45),
     1STRI(45),XLP(45),DMD(5),INAME(30),STID(45),STTI(45),FXX(45)
      COMMON SMD,STBGID,STBGOD,SCSGID,STVD,SWTBG,SWE,SFDC,
     1SFDT,SANG,SCHP,STHP,SAD,SAI,SAS,SRR,SER,SIN,SDL,SFGS,
     1FA,FF,FFR,AP,V9,E9,XLN,XLF,DLF,FP,NS
      REAL MDH
      E9=30.E6
      V9=.3
      B9=6.9E-6
C     DATA INPUT SECTION
      REWIND 9
    5 READ 6,IA
    6 FORMAT (80A1)
      IF(EOF(5LUNPUT))7,1
    1 WRITE(9,6)IA
      GO TO 5
    7 END FILE 9
      REWIND 9
   50 READ(9,6)IA
      IF(EOF(9))1000,51
   51 IF(IA(1).NE.1H1)GO TO 999
      BACKSPACE 9
  100 FORMAT (10X,30A1)
      ICASE=0
      READ(9,6)IA
      IF(IA(1).NE.1H2)GO TO 999
      BACKSPACE 9
      READ(9,110)XN
  110 FORMAT (10X,F10.2)
      IC=INT(XN/3.+.8)
      MND=INT(XN+.01)
      DO 120 I=1,IC
      READ(9,6)IA
      IF(IA(1).NE.1H2)GO TO 999
  120 CONTINUE
      DO 130 I=1,IC
```

```
130 BACKSPACE 9
    READ(9,140)(TVDH(I),MDH(I),I=1,NHD)
140 FORMAT (10X,6F10.2)
    READ(9,6)IA
    IF(IA(1).NE.1H3)GO TO 999
    BACKSPACE 9
    READ(9,110)XN
    NCSG=INT(XN+.01)
    IC=INT(XN/3.+.8)
    DO 150 I=1,IC
    READ(9,6)IA
    IF(IA(1).NE.1H3)GO TO 999
150 CONTINUE
    DO 160 I=1,IC
160 BACKSPACE 9
    READ(9,140)(CSGID(I),CSGMD(I),I=1,NCSG)
    READ(9,6)IA
    IF(IA(1).NE.1H4)GO TO 999
    BACKSPACE 9
    READ(9,110)XN
    NTBG=INT(XN+.01)
    DO 170 I=1,NTBG
    READ(9,6)IA
    IF(IA(1).NE.1H4)GO TO 999
    BACKSPACE 9
    READ(9,180)TBGID(I),TBGOD(I),WTBG(I),TBGMD(I)
170 CONTINUE
180 FORMAT (10X,3F10.6,F10.2)
231 ICASE=ICASE+1
    READ(9,6)IA
    IF(IA(1).NE.1H5)GO TO 999
    BACKSPACE 9
    READ(9,140)XN,PKIO,IAVGI,SLAOFF,THPI,CHPI
    IPKTY=INT(XN+.01)
    READ(9,6)IA
    IF(IA(1).NE.1H6)GO TO 999
    BACKSPACE 9
    READ(9,110)XN
    NFDCI=INT(XN+.01)
    IC=INT(XN/3.+.8)
    DO 200 I=1,IC
    READ(9,6)IA
    IF(IA(1).NE.1H6)GO TO 999
200 CONTINUE
    DO 210 I=1,IC
210 BACKSPACE 9
    READ(9,140)(FDCI(I),FDCMDI(I),I=1,NFDCI)
    READ(9,6)IA
    IF(IA(1).NE.1H7)GO TO 999
    BACKSPACE 9
    READ(9,110)XN
    NFDTI=INT(XN+.01)
    IC=INT(XN/3.+.8)
    DO 220 I=1,IC
    READ(9,6)IA
    IF(IA(1).NE.1H7)GO TO 999
220 CONTINUE
    DO 230 I=1,IC
230 BACKSPACE 9
    READ(9,140)(FDTI(I),FDTMDI(I),I=1,NFDTI)
    READ(9,6)IA
    IF(EOF(9))1000,232
232 IF(IA(1).NE.1H8)GO TO 999
    BACKSPACE 9
    READ(9,190)IAVGF,THPF,CHPF
190 FORMAT (10X,3F10.2)
    READ(9,6)IA
    IF(IA(1).NE.1H9)GO TO 999
    BACKSPACE 9
    READ(9,110)XN
    NFDCF=INT(XN+.01)
    IC=INT(XN/3.+.8)
    DO 240 I=1,IC
    READ(9,6)IA
    IF(IA(1).NE.1H9)GO TO 999
240 CONTINUE
    DO 250 I=1,IC
250 BACKSPACE 9
    READ(9,140)(FDCF(I),FDCMDF(I),I=1,NFDCF)
    READ(9,6)IA
    IF(IA(2).NE.1H0)GO TO 999
    BACKSPACE 9
    READ(9,110)XN
    NFDTF=INT(XN+.01)
    IC=INT(XN/3.+.8)
    DO 260 I=1,IC
    READ(9,6)IA
    IF(IA(2).NE.1H0)GO TO 999
260 CONTINUE
    DO 270 I=1,IC
270 BACKSPACE 9
    READ(9,140)(FDTF(I),FDTMDF(I),I=1,NFDTF)
    READ(9,6)IA
```

```
      IF(IA(2).NE.IH1)GO TO 999
      BACKSPACE 9
      READ(9,110)XN
      NFGS=INT(XN+.01)
      IC=INT(XN/3.+.8)
      DO 280 I=1,IC
      READ(9,6)IA
      IF(IA(2).NE.IH1)GO TO 999
  280 CONTINUE
      DO 290 I=1,IC
  290 BACKSPACE 9
      READ(9,140)(FGS(I),FGSMD(I),I=1,NFGS)
      NS=1
      ITBG=NTBG-1
      ICSG=NCSG-1
      IFDCI=NFDCI-1
      IFDCF=NFDCF-1
      IFDTI=NFDTI-1
      IFDTF=NFDTF-1
      IFGS=NFGS-1
      SMD(1)=TBGMD(NTBG)
  300 IF(SMD(1).LT.MDH(NMD-1))GO TO 305
      CA=(TVDH(NMD)-TVDH(NMD-1))/(MDH(NMD)-MDH(NMD-1))
      SANG(1)=ACOS(CA)
      IF(MDH(NMD).EQ.SMD(1))GO TO 310
      TVDH(NMD)=CA*(SMD(1)-MDH(NMD-1))+TVDH(NMD-1)
      MDH(NMD)=SMD(1)
      GO TO 310
  305 NMD=NMD-1
      GO TO 300
  310 INMD=NMD-1
      IF(INMD.EQ.1)GO TO 320
      DO 330 I=2,INMD
      NS=NS+1
  330 SMD(NS)=MDH(I)
  320 IF(ITBG.EQ.0)GO TO 340
      DO 350 I=1,ITBG
      NS=NS+1
  350 SMD(NS)=TBGMD(I)
  340 IF(ICSG.EQ.0)GO TO 360
      DO 370 I=1,ICSG
      NS=NS+1
  370 SMD(NS)=CSGMD(I)
  360 IF(IFDCI.EQ.0)GO TO 380
      DO 390 I=1,IFDCI
      NS=NS+1
  390 SMD(NS)=FDCMDI(I)
  380 IF(IFDCF.EQ.0)GO TO 400
      DO 410 I=1,IFDCF
      NS=NS+1
  410 SMD(NS)=FDCMDF(I)
  400 IF(IFDTI.EQ.0)GO TO 420
      DO 430 I=1,IFDTI
      NS=NS+1
  430 SMD(NS)=FDTMDI(I)
  420 IF(IFDTF.EQ.0)GO TO 440
      DO 450 I=1,IFDTF
      NS=NS+1
  450 SMD(NS)=FDTMDF(I)
  440 IF(IFGS.EQ.0)GO TO 460
      DO 470 I=1,IFGS
      NS=NS+1
  470 SMD(NS)=FGSMD(I)
  460 NSI=1
  465 NSI=NSI+1
      IF(NSI.GE.NS)GO TO 500
      XMD=SMD(NSI)
      IX=NSI
  467 IX=IX+1
  475 IF(IX.GT.NS)GO TO 465
      IF(SMD(IX)-XMD)467,480,490
  490 SMD(NSI)=SMD(IX)
      SMD(IX)=XMD
      XMD=SMD(NSI)
      GO TO 467
  480 SMD(IX)=SMD(NS)
      NS=NS-1
      IF(IX-NS-1)475,465,465
  500 SWTBG(1)=WTBG(NTBG)
      STBGID(1)=TBGID(NTBG)
      STBGOD(1)=TBGOD(NTBG)
      SCSGID(1)=CSGID(NCSG)
      SMD(NS+1)=MDH(1)
      STVD(NS+1)=TVDH(1)
      DO 510 I=2,NS
      STBGID(I)=STBGID(I-1)
      STBGOD(I)=STBGOD(I-1)
      SCSGID(I)=SCSGID(I-1)
      SANG(I)=SANG(I-1)
      IF(ITBG.EQ.0)GO TO 520
      IF(SMD(I).NE.TBGMD(ITBG))GO TO 520
      STBGOD(I)=TBGOD(ITBG)
      STBGID(I)=TBGID(ITBG)
      SWTBG(I)=WTBG(ITBG)
```

```
      ITBG=ITBG-1
  520 IF(ICSG.EQ.0)GO TO 530
      IF(SMD(I).NE.CSGMD(ICSG))GO TO 530
      SCSGID(I)=CSGID(ICSG)
      ICSG=ICSG-1
  530 IF(INHD.EQ.1)GO TO 510
      IF(SMD(I).NE.MDH(INHD))GO TO 510
      ACC=(TVDH(INHD)-TVDH(INHD-1))/(MDH(INHD)-MDH(INHD-1))
      SANG(I)=ACOS(ACC)
      INHD=INHD-1
  510 CONTINUE
      DO 540 II=1,NS
      I=NS+1-II
      SDL(I)=SMD(I)-SMD(I+1)
      STVD(I)=SDL(I)*COS(SANG(I))+STVD(I+1)
      SAO(I)=3.1416*STBGOD(I)**2/4.
      SAI(I)=3.1416*STBGID(I)**2/4.
      SAS(I)=SAO(I)-SAI(I)
      SRR(I)=STBGOD(I)/STBGID(I)
      SER(I)=(SCSGID(I)-STBGOD(I))/2.
      SIM(I)=3.1416*(STBGOD(I)**4-STBGID(I)**4)/64.
  540 CONTINUE
      AP=3.1416*PK10**2/4.
      SI=0
      K1=1
      DD(1)=0
      DDD(1)=SMD(1)
      CALL CALC(CHPI,THPI,NFDCI,NFDTI,K1,FDCI,FDTI,DD,FDCHDI,FDTMDI,DDD,
     1SLADFF,XL1I,XL2I,XL3I,XL4I)
      CALL CALC(CHPF,THPI,NFDCF,NFDTF,NFGS,FDCF,FDTF,FGS,FDCHDF,FDTMDI,(
     1GSMD,SI,XL1F,XL2F,XL3F,XL4F)
      FP=0.
      XL1=0.
      DO 550 I=1,NS
      XL1F(I)=XL1F(I)-XL1I(I)
      XLP(I)=XL2F(I)
      XL2F(I)=XL2F(I)-XL2I(I)
      XL3F(I)=XL3F(I)-XL3I(I)
      XL4F(I)=XL4F(I)-XL4I(I)
      XL5F(I)=SDL(I)*12.*89*(TAVGF-TAVGI)
  550 XLT=XLT+XL1F(I)+XL2F(I)+XL3F(I)+XL4F(I)+XL5F(I)
      IF(IPKTY.EQ.1)GO TO 600
      IF(IPKTY.EQ.3)GO TO 650
      IF(IPKTY.NE.2)GO TO 990
      IF(XLT.LE.0)GO TO 600
  650 AEL=0
      DO 660 I=1,NS
      XL2F(I)=XLP(I)
  660 AEL=AEL+SDL(I)/SAS(I)*12.
      AEL=AEL/E9
      [illegible]

      XMAX=STTI(1)
      XMMD=SMD(J)
  694 EX=(STHP(I)-SRR(I)**2*SCHP(I))/(SRR(I)**2-1.)+FA(I)/SAS(I)
      BST=0.
      IF(FF(I).LE.0)GO TO 690
      IF (XLP(I).GE.0.) GO TO 690
      BST=STBGOD(I)*SER(I)/4./SIM(I)*FF(I)
      EX=ABS(EX)+ABS(BST)
  690 EX=EX**2
      STRO(I)=3*((STHP(I)-SCHP(I))/(SRR(I)**2-1.))**2+EX
      STRO(I)=SQRT(STRO(I))
      IF(XMAX.GE.STRO(I))GO TO 697
      XMAX=STRO(I)
      XMMD=SMD(I)
  697 EX=(STHP(I)-SRR(I)**2*SCHP(I))/(SRR(I)**2-1.)+FA(I)/SAS(I)
      BSTR=BST/SRR(I)
      EX=(ABS(EX)+ABS(BSTR))**2
      STRI(I)=3*(SRR(I)**2*(STHP(I)-SCHP(I))/(SRR(I)**2-1.))**2+EX
      STRI(I)=SQRT(STRI(I))
      IF(XMAX.GE.STRI(I))GO TO 699
      XMAX=STRI(I)
      XMMD=SMD(I)
  699 CONTINUE
      AXLT=ABS(XLT)
      WRITE 700,INANE,ICASE
  700 FORMAT(1H1,//,1X,29X,30A1,5X,9HCASE NO. ,I2,//)
      IF(IPKTY.EQ.1)GO TO 710
      IF(IPKTY.EQ.2)GO TO 720
      WRITE 705
  705 FORMAT (1X,27HPACKER PERMITTED NO MOTION.,/)
      GO TO 730
  710 WRITE 715
  715 FORMAT (1X,29HPACKER PERMITTED FREE MOTION.,/)
      GO TO 730
  720 WRITE 725
  725 FORMAT (1X,32HPACKER PERMITTED LIMITED MOTION.,/)
  730 IF(FP.NE.0.) GO TO 736
      WRITE 735,XLT
  735 FORMAT (1X,15HLENGTH CHANGED=,F8.2,1X,3HIN.,/,1X,15X,43H(NEGATIVE-
     1SHORTENING, POSITIVE-LENGTHENING),/)
      GO TO 739
  736 WRITE 737,XLT,DLF
  737 FORMAT(1X,21HTOTAL LENGTH CHANGE =,F8.2,4H IN.,3X,10H(WOULD BE ,
     1F8.2,1X,36HIF. IF PACKER PERMITTED FREE MOTION))
  739 WRITE 740,AXLT
  740 FORMAT (1X,29HMINIMUM SEAL LENGTH REQUIRED=,F8.2,1X,41HIN. + LENGT
     1H OF ONE SET OF SEAL ELEMENTS.,/)
```

```
      WRITE 745,XMAX,XMMD
  745 FORMAT (1X,24HMAXIMUM COMBINED STRESS=,F10.2,
     112H PSI. AT MD=,F8.2,4H FT.,/,1X,24X,
     146H(MAXIMUM COMBINED STRESS SHOULD NOT EXCEED 80%,
     11X,22HOF THE MINIMUM YIELD.),/)
      WRITE 750,FP,SLADEF
  750 FORMAT (1X,23HPACKER TO TUBING FORCE=,F10.2,4H LB.,26X,
     1/,9X,15HINITIAL SLADEF=,F10.2,4H LB.,/,1X,23X,
     140H(POSITIVE-COMPRESSION, NEGATIVE-TENSION),/)
      FP1=0.
      ICC=0
  670 FP=(FP1+FP2)/2.
      ICC=ICC+1
      CALL FFORCE(XL2F)
      DLF=DLF-FP*AFL
      C9=(DLF+XLT)/XLT
      C9=ABS(C9)
      IF(C9.LE..001)GO TO 680
      IF(ICC.GT.30)GO TO 997
      IF(ABS(DLF).GT.ABS(XLT))GO TO 685
      FP1=FP
      GO TO 670
  685 FP2=FP
      GO TO 670
  680 DLF=XLT
      XLT=0.
      DO 689 I=1,NS
      XL2F(I)=XLP(I)-XL2I(I)
  689 XL1F(I)=XL1F(I)-FP*SDL(I)*12./E9/SAS(I)
  600 XLNMD=SMD(1)-XLN
      XMAX=0.
      FF(NS+1)=FF(NS)-SDL(NS)*SWT(NS)*COS(SANG(NS))
      IF (FF(NS+1).GT.0.) GO TO 603
      FF(NS+1)=0.
  603 FA(NS+1)=FA(NS)-SDL(NS)*SWTBG(NS)*COS(SANG(NS))
      SRR(NS+1)=SRI(NS)
      SAS(NS+1)=SAS(NS)
      STBGOD(NS+1)=STBGOD(NS)
      SER(NS+1)=SER(NS)
      SIN(NS+1)=SIN(NS)
      NS9=NS+1
      DO 607 I=1,NS
      FXX(I)=FA(I)+(FFR(I+1)+(FP-SDL(I)*SWTBG(I)*COS(SANG(I)))
  607 FA(I)=FA(I)+(FP+FFR(I)
      DO 699 I=1,NS
      J=I+1
      EX=(STHP(J)-SRR(I)**2+SCHP(J))/(SRR(I)**2-1.)+
     1(FA(I)-SDL(I)*SWTBG(I)*COS(SANG(I))-FFR(I)+FFR(J))/SAS(I)
      BST=0.
      IF(FF(J).LE.0)GO TO 691
      IF (XLP(I).GE.0.) GO TO 691
      BST=STBGOD(I)*SER(I)/4./SIN(I)*FF(J)
      EX=ABS(EX)+ABS(BST)
  691 EX=EX**2
      STTO(I)=3*((STHP(J)-SCHP(J))/(SRR(I)**2-1.))**2+EX
      STTO(I)=SQRT(STTO(I))
      IF(XMAX.GE.STTO(I))GO TO 692
      XMAX=STTO(I)
      XMMD=SMD(J)
  692 EX=(STHP(J)-SRR(I)**2+SCHP(J))/(SRR(I)**2-1.)+
     1(FA(I)-SDL(I)*SWTBG(I)*COS(SANG(I))-FFR(I)+FFR(J))/SAS(I)
      BSTR=BST/SRR(I)
      EX=(ABS(EX)+ABS(BSTR))**2
      STTI(I)=3*(SRR(I)**2*(STHP(J)-SCHP(J))/(SRR(I)**2-1.))**2+EX
      STTI(I)=SQRT(STTI(I))

  755 FORMAT (1X,20HNEUTRAL POINT AT MD=,F8.2,4H FT.,
     1///,1X,29X,15HDETAILED OUTPUT,/,1X,29X,
     115H---------------,/)
      WRITE 760
  760 FORMAT(1X,78X,7HPRESENT,/,1X,78X,8HABSOLUTE,/1X,23X,
     16(6HLENGTH,5X),19H COMBINED STRESS AT,6X,19H COMBINED STRESS AT,
     1/,1X,23X,6(8HCHANGE- ,3X),2X,15HINNER WALL, PSI,9X,
     115HOUTER WALL, PSI,/,1X,2X,15HSECTION BETWEEN,
     1 6X,6HPISTON,5X,8HBUCKLING,3X,7HBALLOON,4X,
     16HFRICTION,3X,8HTEMPERA-,3X,8HBUCKLING,
     12(3X,6HTOP OF,6X,9HBOTTOM OF),
     1/,1X,2X,17HMD,FT. AND MD,FT.,6X,3HIN.,8X,
     13HIN.,6X,8H-ING,IN.,5X,3HIN.,6X,8HURE,IN.,5X,
     13HIN.,1X,4(5X,7HSECTION),/,1X,
     16(9H---------,2X),4(10H----------,2X))
  765 FORMAT(1X,6(F9.2,2X),4(F10.2,2X))
      DO 770 II=1,NS
      I=NS+1-II
  770 WRITE 765,SMD(I+1),SMD(I),XL1F(I),XL2F(I),XL3F(I),XL4F(I),
     1XL5F(I),XLP(I),STII(I),STRI(I),STTO(I),STRO(I)
      IF(NS.EQ.1) GO TO 774
      X1=0.
      X2=0.
      X3=0.
      X4=0.
      X5=0.
      X6=0.
      DO 771 I=1,NS
      X1=X1+XL1F(I)
      X2=X2+XL2F(I)
```

```
      X3=X3+XL3F(I)
      X4=X4+XL4F(I)
      X5=X5+XL5F(I)
  771 X6=X6+XLP(I)
      WRITE 772,X1,X2,X3,X4,X5,X6
  772 FORMAT(1X,22X,6(9H---------,2X),/,1X,15X,5HTOTAL,6(2X,F9.2))
  774 WRITE 773
  773 FORMAT (1X,///,1X,24X,16HAXIAL FORCE, LB.,7X,15HPRESSURE, PSIG.,
     1/,1X,1X,15HSECTION BETWEEN,7X,19HTOP OF    BOTTOM OF,3X,
     120HAT BOTTOM OF SECTION,/,1X,1X,17HMD,FT. AND MD,FT.,5X,
     140HSECTION    SECTION      TUBING      ANNULUS,/,1X,
     16(9H---------,2X))
  801 FORMAT (1X,2(F9.2,2X),2(F9.0,2X),2(F9.2,2X))
      DO 802 II=1,NS
      I=NS+1-II
  802 WRITE 801,SMD(I+1),SMD(I),FXX(I),FA(I),STHP(I),SCHP(I)
      WRITE 775,IPKTY,PKID
  775 FORMAT(1H1,//,1X,29X,17HINPUT INFORMATION,/,1X,29X,
     116H----------,//,1X,16HPACKER TYPE NO.=,
     1I2,/,1X,15HPACKER BORE ID=,F7.4,4H IN.)
      WRITE 780,TAVGI,TAVGF,THPI,THPF,CHPI,CHPF,SLADFF
  780 FORMAT (1X,28HINITIAL AVERAGE TEMPERATURE=,F7.2,3H F.,
     112X,28HPRESENT AVERAGE TEMPERATURE=,F7.2,3H F.,/,1X,
     129HINITIAL TUBING HEAD PRESSURE=,F9.2,5H PSI.,7X,
     129HPRESENT TUBING HEAD PRESSURE=,F9.2,5H PSI.,/,1X,
     129HINITIAL CASING HEAD PRESSURE=,F9.2,5H PSI.,7X,
     129HPRESENT CASING HEAD PRESSURE=,F9.2,5H PSI.,/,1X,
     115HINITIAL SLACKOFF=,F10.2,4H LB.)
      WRITE 791,E9,V9,B9
  791 FORMAT(1X,16HYOUNG'S MODULUS=,E10.3,4H PSI,/,1X,
     116HPOISSON'S RATIO=,F5.2,/,1X,28HCOEFF. OF THERMAL EXPANSION=,
     1E10.3,6H /1 F.,/)
      WRITE 785
  785 FORMAT (/,1X,23X,5HANGLE, 98X,7HPRESENT,/,1X,23X,
     18HOF  INCL1,37X,7HINITIAL,5X,7HPRESENT,5X,7HINITIAL,
     15X,7HPRESENT,15X,8HFRICTION,/,1X,23X,7H-RATION,
     16X,3HCSG,8X,3HTBG,8X,3HTBG,6X,9HCSG FLUID,
     13X,9HCSG FLUID,3X,9HTBG FLUID,3X,9HTBG FLUID,
     14X,7HTBG WT.,3X,6HGRAD.,/,1X,2X,6HMD,FT.,
     14X,7HTVD,FT.,4X,6HDEGREE,6X,6HID,IN.,5X,
     16HOD,IN.,5X,6HID,IN.,5X,6HLB/GAL,6X,6HLB/GAL,
     16X,6HLB/GAL,6X,6HLB/GAL,6X,6HLB/FT.,4X,
     116HPSI/1000FT,/,1X,2(9H---------,1X),2X,8H--------,3X,
     13(1X,8H--------,2X),5(2X,8H--------,2X),2X,8H--------)
      WRITE 786,SMD(NS+1),STVD(NS+1)
  786 FORMAT (1X,F9.2,1X,F10.2)
      IFC=1
      IFT=1
      CSF=FDCI(1)
      TBF=FDTI(1)
      DO 790 II=1,NS
      I=NS+1-II
      SANG(I)=SANG(I)*180./3.1416
      IF(IFC.GE.NFDC)GO TO 787
      IF(SMD(I).LE.FDCMDI(IFC))GO TO 787
      IFC=IFC+1
      CSF=FDCI(IFC)
  787 IF(IFT.GE.NFDT)GO TO 788
      IF(SMD(I).LE.FDTMDI(IFT))GO TO 788
      IFT=IFT+1
      TBF=FDTI(IFT)
  788 WRITE 789,SMD(I),STVD(I),SANG(I),SCSGID(I),
     1STBGOD(I),STBGID(I),CSF,SFDC(I),TBF,
     1SFDT(I),SWTBG(I),SFGS(I)
  789 FORMAT (1X,F9.2,1X,F10.2,2X,F8.2,3X,3(1X,F8.3,2X),5(2X,F7.2,3X),2X
     1,F8.3)
  790 CONTINUE
      READ(9,6)IA
      IF(EOF(9))1000,900
  900 IF(IA(2).EQ.1H2)GO TO 211
      IF(IA(2).EQ.1H3)GO TO 50
  999 WRITE 899
  899 FORMAT (1X,29HERROR IN DATA INPUT SEQUENCE.)
 1000 STOP
  898 WRITE 898,IPKTY
  898 FORMAT (1X,40HPACKER TYPE NO.IS NEITHER 1,2,NOR 3, BUT,I2)
      STOP
  897 WRITE 897,FP1,FP2,DLF,XLT,C9
  897 FORMAT (1X,29HFP ITERATION GREATER THAN 30.,/,1X,
     14HFP1=,F10.2,5X,4HFP2=,F10.2,/,1X,4HDLF=,
     1F10.2,5X,4HXLT=,F10.2,5X,3HC9=,F10.5)
      STOP
      END


      SUBROUTINE CALC(CHP,THP,NFDC,NFDT,NFGS,FDC,FDT,FGS,
     1FDCMD,FDTMD,FGSMD,SLADFF,XL1,XL2,XL3,XL4)
      DIMENSION XL1(45),XL2(45),XL3(45),XL4(45),FDC(5),FDT(5),
     1FGS(5),FDCMD(5),FDTMD(5),FGSMD(5),SMD(45),STBGID(45),
     1STBGOD(45),STVD(45),SWTBG(45),SWF(45),SFDC(45),SFDT(45),
     1SANG(45),SCHP(45),STHP(45),SAO(45),SAI(45),SAS(45),SRR(45),
     1SER(45),SFGS(45),FFR(45),FA(45),FF(45),XLP(45),SDL(45),SIN(45),
     1SCSGID(45)
      COMMON SMD,STBGID,STBGOD,SCSGID,STVD,SWTBG,SWF,SFDC,
     1SFDT,SANG,SCHP,STHP,SAO,SAI,SAS,SRR,SER,SIN,SDL,SFGS,
     1FA,FF,FFR,AP,V9,E9,XLN,XLP,DLF,FP,NS
      SFDC(1)=FDC(NFDC)
      SFDT(1)=FDT(NFDT)
      SFGS(1)=FGS(NFGS)
```

```
      IFDC=NFDC-1
      IFDT=NFDT-1
      IFGS=NFGS-1
      DO 10 I=2,NS
      SFDC(I)=SFDC(I-1)
      SFDT(I)=SFDT(I-1)
      SFGS(I)=SFGS(I-1)
      IF(IFDC.EQ.0)GO TO 20
      IF(SMD(I).NE.FDCMD(IFDC))GO TO 20
      SFDC(I)=FDC(IFDC)
      IFDC=IFDC-1
   20 IF(IFDT.EQ.0)GO TO 30
      IF(SMD(I).NE.FDTMD(IFDT))GO TO 30
      SFDT(I)=FDT(IFDT)
      IFDT=IFDT-1
   30 IF(IFGS.EQ.0)GO TO 10
      IF(SMD(I).NE.FGSMD(IFGS))GO TO 10
      SFGS(I)=FGS(IFGS)
      IFGS=IFGS-1
   10 CONTINUE
      SCHP(NS+1)=CHP
      STHP(NS+1)=THP
      DO 35 II=1,NS
      I=NS+1-II
      SCHP(I)=SCHP(I+1)+SFDC(I)*.052*SDL(I)*COS(SANG(I))
      STHP(I)=STHP(I+1)+SFDT(I)*.052*SDL(I)*COS(SANG(I))-SFGS(I)
     1*SDL(I)/1000.
      SWE(I)=SWTBG(I)-SAD(I)*SFDC(I)*12./231.+SAI(I)*SFDT(I)
     1*12./231.
   35 CONTINUE
      NS9=NS+1
      DO 40 I=1,NS9
      IF(I)=0.
      FFR(I)=0.
      FA(I)=0.
      XL1(I)=0
      XL2(I)=0
      XL3(I)=0
   40 XL4(I)=0
      XLN=0
      FA(1)=(AP-SAI(1))*STHP(1)-(AP-SAD(1))*SCHP(1)+SLADFF
      DO 50 I=1,NS
      XL1(I)=-FA(I)*12.*SDL(I)/E9/SAS(I)
      IF(I.EQ.NS)GO TO 50
      FA(I+1)=FA(I)+(SAI(I)-SAI(I+1))*STHP(I+1)+(SAD(I+1)-SAD(I))
     1*SCHP(I+1)-SDL(I)*SWTBG(I)*COS(SANG(I))
   50 CONTINUE
      FF(1)=(STHP(1)-SCHP(1))*AP+SLADFF
      DO 60 I=1,NS
      IF (FF(I).GT.0.) GO TO 55
      FF(I)=0.
      GO TO 70
   55 XMC=(E9*SIM(I)/SWE(I)*12.)**(1./3)
      FC=(XMC*SIN(SANG(I))/SER(I))**.436*2.93*XMC*SWE(I)/12.
      XLC=FF(I)/SWE(I)/COS(SANG(I))
      XLN=XLN+XLC
      IF(XLC.LE.SDL(I))GO TO 80
      XLN=XLN-XLC+SDL(I)
   80 IF(FF(I).LE.FC)GO TO 90
      XL2(I)=-SER(I)**2*FF(I)**2*12./8./E9/SIM(I)/SWE(I)
     1/COS(SANG(I))
      IF(XLC.LE.SDL(I))GO TO 70
      XA=SDL(I)*COS(SANG(I))*SWE(I)/FF(I)
      XL2(I)=XL2(I)*XA*(2.-XA)
   90 FF(I+1)=FF(I)-SDL(I)*SWE(I)*COS(SANG(I))
   60 CONTINUE
   70 DO 100 I=1,NS
      PI=(STHP(I)+STHP(I+1))/2.
      PO=(SCHP(I)+SCHP(I+1))/2.
  100 XL3(I)=-24.*V9*(PI-SRR(I)**2*PO)*SDL(I)/(SRR(I)
     1**2-1)/E9
      DO 110 I=1,NFGS
      IF(FGS(I).GT.0)GO TO 130
      IF(FGS(I).LT.0)GO TO 120
  110 CONTINUE
      RETURN
  120 FFR(1)=0
      DO 125 I=1,NS
      FFR(I+1)=FFR(I)-SDL(I)*SFGS(I)/1000.+SAI(I)
      XL4(I)=-SDL(I)*12.*(FFR(I)+FFR(I+1))/2./E9/SAS(I)
  125 CONTINUE
      RETURN
  130 FFR(NS+1)=0
      DO 135 II=1,NS
      I=NS+1-II
      FFR(I)=FFR(I+1)-SDL(I)*SFGS(I)/1000.+SAI(I)
      XL4(I)=-SDL(I)*12.*(FFR(I)+FFR(I+1))/2./E9/SAS(I)
  135 CONTINUE
      RETURN
      END
```

```
      SUBROUTINE IFORCE(XL2F)
      DIMENSION SMD(45),STBGID(45),STBGOD(45),STVD(45),SWTBG(45),
     1SWE(45),SFDC(45),SFDT(45),SANG(45),SCHP(45),STHP(45),
     1SAO(45),SAI(45),SAS(45),SRR(45),SER(45),SFGS(45),FFR(45),
     1FA(45),FF(45),XLP(45),XL2F(45),SDL(45),SIM(45),SCSGID(45)
      COMMON SMD,STBGID,STBGOD,SCSGID,STVD,SWTBG,SWE,
     1SFDC,SFDT,SANG,SCHP,STHP,SAO,SAI,SAS,SRR,SER,SIM,
     1SDL,SFGS,FA,FF,FFR,AP,VO,EG,XLN,XLP,DLF,FP,NS
      XLN=0.
      DO 10 I=1,NS
      FF(I)=0.
   10 XLP(I)=0
      DLF=0
      FF(1)=FP+(STHP(1)-SCHP(1))*AP
      DO 20 I=1,NS
      IF (FF(I).GT.0.) GO TO 15
      FF(I)=0.
      GO TO 30
   15 XMC=(EG*SIM(I)/SWE(I)*10.)**(1./3.)
      FC=(XMC*SIM(SANG(I))/SER(I))*1.436+2.93*XMC*
     1SWE(I)/12.
      XLC=FF(I)/SWE(I)/COS(SANG(I))
      XLN=XLN+XLC
      IF(XLC.LE.SDL(I))GO TO 40
      XLN=XLN-XLC+SDL(I)
   40 IF(FF(I).LE.FC)GO TO 50
      XLP(I)=-SER(I)*2*FF(I)*12./6./EG/SIM(I)
     1/SWE(I)/COS(SANG(I))
      IF(XLC.LE.SDL(I))GO TO 50
      XA=SDL(I)*COS(SANG(I))*SWE(I)/FF(I)
      XLP(I)=XLP(I)*XA*(2.-XA)
   50 FF(I)=FF(I)-SDL(I)*SWE(I)*COS(SANG(I))
   20 CONTINUE
   30 DO 60 I=1,NS
   60 DLF=XLP(I)-XL2F(I)+DLF
      RETURN
      END
```

What is claimed is:

1. The method of determining the length change of a string of tubing in a vertical or deviated well caused by fluid flow through said tubing during production or stimulation of the well comprising:

measuring the fluid pressure where it enters said tubing;

for successive sections of said tubing, determining the actual force applied to said tubing from said fluid pressure acting upon the cross-sectional area of said tubing;

measuring the inclination of said sections of said tubing;

determining the weight of each section;

resolving the weight of each section into the axial component applied to the next successive segment, said axial component being related to the measured inclination of the sections;

for each of said successive sections, determining the buckling force from said actual force and said axial component of weight;

comparing said buckling force to a threshold to determine if there is buckling of said tubing;

determining the length change of said tubing between the initial condition and the condition of fluid flow in said tubing caused by the pressure and temperature of said fluid and caused by buckling if it is present as determined from the preceding step; and producing an output indicating the change in length of said tubing.

2. The method recited in claim 1 further comprising:

determining the length changes of the tubing due to radial pressure forces by separately determining the length change caused by ballooning or compression of said tubing due to pressure and determining the length change caused by frictional drag.

3. The method recited in claim 1 wherein said tubing string is supported in a packer having a seal, said method further comprising:

measuring the hydrostatic pressure outside of the tubing above said packer, and wherein the step of determining the actual force applied to said tubing includes determining the differential in said fluid pressure where it enters said tubing and said fluid pressure outside of said tubing.

4. The method recited in claim 3 wherein said length change is determined during production of said well, wherein said fluid pressure where it enters said tubing is the formation pressure at the bottom of said tubing string, wherein said pressure outside of said tubing string is the hydrostatic pressure of the casing fluid just above said packer, and wherein the step of determining the actual force applied to said tubing is carried out for successive sections of said tubing starting at the bottom thereof.

5. The method recited in claim 3 wherein said length change is determined during stimulation of said well, wherein said fluid pressure where it enters said tubing is the pressure of the stimulation fluid at the top of said tubing string, wherein said pressure outside of said tubing string is the hydrostatic pressure of the casing fluid just below the annulus, and wherein the step of determining the actual force applied to said tubing is carried out for successive sections of said tubing starting at the top thereof.

6. The method recited in claim 1 further comprising:

determining the stress applied to each section of said tubing; and producing an output indicating said stress.

7. The method recited in claim 1 wherein the step of determining the weight of each section includes determining the buoyed weight of each section from the weight of the section in air, the density of the fluid in which the section is immersed, and the cross-sectional area of the section.

8. The method of producing an output useful in the analysis of a well, in which fluid flows through a string of tubing during production or stimulation of the well, from inputs representing the fluid pressure where it enters said tubing, the inclination of sections of said tubing and the physical parameters of said tubing comprising:

for successive sections of said tubing, determining the actual force applied to said tubing from said fluid pressure acting upon the cross-sectional area of said tubing;

determining the weight of each section;

resolving the weight of each section into the axial component applied to the next successive segment, said axial component being related to the inclination of the sections;

for each of said successive sections, determining the buckling force from said actual force and said axial component of weight;

comparing said buckling force to a threshold to determine if there is buckling of said tubing;

determining the length change of said tubing between the initial condition and the condition of fluid flow in said tubing caused by the pressure and temperature of said fluid and caused by buckling if it is present as determined from the preceding step;

determining the stress applied to each section of said tubing; and producing an output indicating the change in length of said tubing and the stress applied to each section of said tubing.

9. The method recited in claim 8 further comprising:

determining the length changes of the tubing due to radial pressure forces by separately determining the length change caused by ballooning or compression of said tubing due to pressure and determining the length change caused by frictional drag.

10. The method recited in claim 8 wherein the step of determining the weight of each section includes determining the buoyed weight of each section from the weight of the section in air, the density of the fluid in which the section is immersed, and the cross-sectional area of the section.

* * * * *